US006392650B1

(12) United States Patent
Morrish et al.

(10) Patent No.: US 6,392,650 B1
(45) Date of Patent: May 21, 2002

(54) CHARACTER LINE ADDRESS COUNTER CLOCK SIGNAL GENERATOR FOR ON SCREEN DISPLAYS

(75) Inventors: Andrew Morrish, Saratoga, CA (US); Gregory L. Dean, Standish, ME (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/312,182

(22) Filed: May 14, 1999

(51) Int. Cl.[7] ..... G09G 5/00

(52) U.S. Cl. ..... 345/472; 345/467; 345/468; 345/469; 345/470; 345/471

(58) Field of Search ..... 345/472, 471, 345/467, 468, 469, 469.1, 472.1, 472.2

(56) References Cited

U.S. PATENT DOCUMENTS

| | | | | | |
|---|---|---|---|---|---|
| 4,087,808 | A | * | 5/1978 | Herndon, Jr. | 340/324 |
| 4,234,931 | A | * | 11/1980 | Kanaiwa et al. | 364/900 |
| 4,314,244 | A | * | 2/1982 | Demke et al. | 340/731 |
| 4,368,466 | A | * | 1/1983 | Dwire | 340/799 |
| 4,451,899 | A | * | 5/1984 | Yamazaki | 364/900 |
| 4,476,464 | A | * | 10/1984 | Hobbs | 340/731 |
| 4,837,729 | A | * | 6/1989 | Funabashi | 364/900 |
| 4,896,148 | A | | 1/1990 | Kurita | 340/731 |
| 5,001,697 | A | * | 3/1991 | Torres | 364/521 |
| 5,339,160 | A | * | 8/1994 | Shindou | 348/571 |
| 5,357,264 | A | * | 10/1994 | Itoh et al. | 345/112 |

OTHER PUBLICATIONS

Motorola Semiconductor Technical Data MC141547P2, "Advanced Monitor On–Screen Display II—16 CMOS", pp. 4–76 through 4–92.

* cited by examiner

*Primary Examiner*—Matthew Luu
*Assistant Examiner*—Daniel J Chung
(74) *Attorney, Agent, or Firm*—Wildman, Harrold, Allen & Dixon

(57) ABSTRACT

A character line address counter clock signal generator for generating a character line address counter clock signal for an on screen display (OSD) circuit used to selectively display a character image within an on screen display contained within a displayed screen image. The character image displayed within the OSD is maintained at a substantially constant image height regardless of the number of image lines contained within the overall displayed screen image. The character image lines for a base character image are displayed in accordance with a predetermined repetition sequence without requiring phase lock loop to generate a reduced character line address clock or requiring arithmetic computation to calculate each character line address. The subject character line address counter clock signal generator uses programmable counters to selectively divide the horizontal synchronization signal to produce a clock signal with an aperiodicity corresponding to the predetermined repetition sequence of selected base character image lines such that selected lines are used R times while other selected lines are used R+1 times.

32 Claims, 8 Drawing Sheets

| HORIZ. PIXELS PER LINE | VERT. LINES | PIXEL HEIGHT (ASSUMING IMAGE HEIGHT=200mm) | 18 LINE OSD CHAR HEIGHT (ASSUMING IMAGE HEIGHT=200mm) |
|---|---|---|---|
| 640 | 480 | .42mm | 7.6mm |
| 800 | 600 | .33mm | 5.9mm |
| 1024 | 768 | .26mm | 4.7mm |

| Number of lines in the image | Number of OSD char lines (N) |
|---|---|
| 320 | 18 |
| 384 | 22 |
| 448 | 26 |
| 512 | 29 |
| 640 | 36 |
| 704 | 40 |
| 768 | 43 |

| | I=0 | I=1 | I=2 | I=3 |
|---|---|---|---|---|
| L=0 | R | R | R | R+1 |
| L=1 | R | R | R+1 | R+1 |
| L=2 | R | R | R | R+1 |
| L=3 | R | R+1 | R+1 | R |

| No. of Image Lines (='V') | 324 | 405 | 486 | 567 | 648 | 729 | 810 |
|---|---|---|---|---|---|---|---|
| Rqd. No. of Char. Lines (N) | 18 | 23 | 27 | 32 | 36 | 41 | 45 |
| Horiz. Line No. (H) | CHAR ADDR. | CHAR ADDR. | CHAR ADDR. | CHAR ADDR. | CHAR ADDR. | CHAR ADDR. | CHAR ADDR. |
| 0 | 0 | 0 | 0 | 0 | 0 | 0 | 0 |
| 1 | 1 | 0 | 0 | 0 | 0 | 0 | 0 |
| 2 | 2 | 1 | 1 | 1 | 1 | 0 | 0 |
| 3 | 3 | 2 | 2 | 1 | 1 | 1 | 1 |
| 4 | 4 | 3 | 2 | 2 | 2 | 1 | 1 |
| 5 | 5 | 3 | 3 | 2 | 2 | 2 | 2 |
| 6 | 6 | 4 | 4 | 3 | 3 | 2 | 2 |
| 7 | 7 | 5 | 4 | 3 | 3 | 3 | 2 |
| 8 | 8 | 6 | 5 | 4 | 4 | 3 | 3 |
| 9 | 9 | 7 | 6 | 5 | 4 | 3 | 3 |
| 10 | 10 | 7 | 6 | 5 | 5 | 4 | 4 |
| 11 | 11 | 8 | 7 | 6 | 5 | 4 | 4 |
| 12 | 12 | 9 | 8 | 6 | 6 | 5 | 4 |
| 13 | 13 | 10 | 8 | 7 | 6 | 5 | 5 |
| 14 | 14 | 10 | 9 | 7 | 7 | 6 | 5 |
| 15 | 15 | 11 | 10 | 8 | 7 | 6 | 6 |
| 16 | 16 | 12 | 10 | 9 | 8 | 7 | 6 |
| 17 | 17 | 13 | 11 | 9 | 8 | 7 | 6 |
| 18 | | 14 | 12 | 10 | 9 | 7 | 7 |
| 19 | | 14 | 12 | 10 | 9 | 8 | 7 |
| 20 | | 15 | 13 | 11 | 10 | 8 | 8 |
| 21 | | 16 | 14 | 11 | 10 | 9 | 8 |
| 22 | | 17 | 14 | 12 | 11 | 9 | 8 |
| 23 | | | 15 | 12 | 11 | 10 | 9 |
| 24 | | | 16 | 13 | 12 | 10 | 9 |
| 25 | | | 16 | 14 | 12 | 10 | 10 |
| 26 | | | 17 | 14 | 13 | 11 | 10 |
| 27 | | | | 15 | 13 | 11 | 10 |
| 28 | | | | 15 | 14 | 12 | 11 |
| 29 | | | | 16 | 14 | 12 | 11 |
| 30 | | | | 16 | 15 | 13 | 12 |
| 31 | | | | 17 | 15 | 13 | 12 |
| 32 | | | | | 16 | 14 | 12 |
| 33 | | | | | 16 | 14 | 13 |
| 34 | | | | | 17 | 14 | 13 |
| 35 | | | | | 17 | 15 | 14 |
| 36 | | | | | | 15 | 14 |
| 37 | | | | | | 16 | 14 |
| 38 | | | | | | 16 | 15 |
| 39 | | | | | | 17 | 15 |
| 40 | | | | | | 17 | 16 |
| 41 | | | | | | | 16 |
| 42 | | | | | | | 16 |
| 43 | | | | | | | 17 |
| 44 | | | | | | | 17 |

FIGURE 5
(PRIOR ART)

| No. of Image Lines (='V') | 320 | 384 | 448 | 512 | 640 | 704 | 768 |
|---|---|---|---|---|---|---|---|
| Required No. of Char. Lines | 18 | 18 | 22 | 27 | 32 | 36 | 40 |
| V/Y (Y=81) | 3 | 4 | 5 | 6 | 7 | 8 | 9 |
| V/Y (binary) | 000 11 | 001 00 | 001 01 | 001 10 | 001 11 | 010 00 | 010 01 |
| R,I | R=0,I=3 | R=1,I=0 | R=1,I=1 | R=1,I=2 | R=1,I=3 | R=2,I=0 | R=2,I=1 |

| Number of lines in the image | Ideal number of OSD char. lines | Approx. method number of OSD char. lines | Error in Character height about ideal |
|---|---|---|---|
| 320 | 18 | 18 | 0% |
| 384 | 22 | 18 | −18% |
| 448 | 26 | 22 | −15% |
| 512 | 29 | 27 | −7% |
| 640 | 36 | 32 | −11% |
| 704 | 40 | 36 | −10% |
| 768 | 43 | 40 | −7% |

| No. of Image Lines (='V') | 324-404 | 405-485 | 486-566 | 567-647 | 648-728 | 729-809 | 810-890 |
|---|---|---|---|---|---|---|---|
| R,I, (using Y=81) | R=1,I=0 | R=1,I=1 | R=1,I=2 | R=1,I=3 | R=2,I=0 | R=2,I=1 | R=2,I=2 |
| H Line No. | CHAR ADDR. | CHAR ADDR. | CHAR ADDR. | CHAR ADDR. | CHAR ADDR. | CHAR ADDR. | CHAR ADDR. |
| 0 | 0 | 0 | 0 | 0 | 0 | 0 | 0 |
| 1 | 1 | 1 | 1 | 0 | 0 | 0 | 0 |
| 2 | 2 | 2 | 1 | 1 | 1 | 1 | 1 |
| 3 | 3 | 3 | 2 | 1 | 1 | 1 | 1 |
| 4 | 4 | 3 | 3 | 2 | 2 | 2 | 1 |
| 5 | 5 | 4 | 3 | 2 | 2 | 2 | 2 |
| 6 | 6 | 5 | 4 | 3 | 3 | 3 | 2 |
| 7 | 7 | 6 | 5 | 4 | 3 | 3 | 3 |
| 8 | 8 | 7 | 5 | 4 | 4 | 3 | 3 |
| 9 | 9 | 7 | 6 | 5 | 4 | 4 | 3 |
| 10 | 10 | 8 | 7 | 5 | 5 | 4 | 4 |
| 11 | 11 | 9 | 7 | 6 | 5 | 5 | 4 |
| 12 | 12 | 10 | 8 | 6 | 6 | 5 | 5 |
| 13 | 13 | 11 | 9 | 7 | 6 | 6 | 5 |
| 14 | 14 | 11 | 9 | 8 | 7 | 6 | 5 |
| 15 | 15 | 12 | 10 | 8 | 7 | 7 | 6 |
| 16 | 16 | 13 | 11 | 9 | 8 | 7 | 6 |
| 17 | 17 | 14 | 11 | 9 | 8 | 7 | 7 |
| 18 | | 15 | 12 | 10 | 9 | 8 | 7 |
| 19 | | 15 | 13 | 10 | 9 | 8 | 7 |
| 20 | | 16 | 13 | 11 | 10 | 9 | 8 |
| 21 | | 17 | 14 | 12 | 10 | 9 | 8 |
| 22 | | | 15 | 12 | 11 | 10 | 9 |
| 23 | | | 15 | 13 | 11 | 10 | 9 |
| 24 | | | 16 | 13 | 12 | 11 | 9 |
| 25 | | | 17 | 14 | 12 | 11 | 10 |
| 26 | | | 17 | 14 | 13 | 11 | 10 |
| 27 | | | | 15 | 13 | 12 | 11 |
| 28 | | | | 16 | 14 | 12 | 11 |
| 29 | | | | 16 | 14 | 13 | 11 |
| 30 | | | | 17 | 15 | 13 | 12 |
| 31 | | | | 17 | 15 | 14 | 12 |
| 32 | | | | | 16 | 14 | 13 |
| 33 | | | | | 16 | 15 | 13 |
| 34 | | | | | 17 | 15 | 13 |
| 35 | | | | | 17 | 15 | 14 |
| 36 | | | | | | 16 | 14 |
| 37 | | | | | | 16 | 15 |
| 38 | | | | | | 17 | 15 |
| 39 | | | | | | 17 | 15 |
| 40 | | | | | | | 16 |
| 41 | | | | | | | 16 |
| 42 | | | | | | | 17 |
| 43 | | | | | | | 17 |
| 44 | | | | | | | 17 |
| 45 | | | | | | | |

FIGURE 11

| No. Image lines | | 486-566 | |
|---|---|---|---|
| R, I, (Y=81) | | R=1, I=2 | |
| H LINE No. | | CHAR ADDR | |
| EVEN | ODD | EVEN | ODD |
| 0 | | 0 | |
| | 1 | | 0 |
| 2 | | 1 | |
| | 3 | | 2 |
| 4 | | 2 | |
| | 5 | | 3 |
| 6 | | 4 | |
| | 7 | | 4 |
| 8 | | 5 | |
| | 9 | | 6 |
| 10 | | 6 | |
| | 11 | | 7 |
| 12 | | 8 | |
| | 13 | | 8 |
| 14 | | 9 | |
| | 15 | | 10 |
| 16 | | 10 | |
| | 17 | | 11 |
| 18 | | 12 | |
| | 19 | | 12 |
| 20 | | 13 | |
| | 21 | | 14 |
| 22 | | 14 | |
| | 23 | | 15 |
| 24 | | 16 | |
| | 25 | | 16 |
| 26 | | 17 | |
| | 27 | | 0 |
| 28 | | 0 | |
| | 29 | | 1 |
| 30 | | 2 | |
| | 31 | | 2 |
| 32 | | 3 | |
| | 33 | | 4 |
| 34 | | 4 | |
| | 35 | | 5 |
| 36 | | 6 | |
| | 37 | | 6 |
| 38 | | 7 | |
| | 39 | | 8 |
| 40 | | 8 | |
| | 41 | | 9 |
| 42 | | 10 | |
| | 43 | | 10 |
| 44 | | 11 | |

Note the character line address of the first character in the Odd field is offset by 1.

CHARACTER 1

CHARACTER 2

FIGURE 14

CHARACTER LINE ADDRESS COUNTER CLOCK SIGNAL GENERATOR FOR ON SCREEN DISPLAYS

BACKGROUND OF THE INVENTION

1. Field of the Invention

The present invention relates to address counter clock signal generators, and in particular, to address counter clock signal generators for addressing base character image information for display within an on screen display ("OSD") contained within a displayed screen image.

2. Description of the Related Art

An OSD character generator is a character font based generator that uses an area of programmable memory to define a page of characters. Each character is defined by an address which points to the character cell matrix stored elsewhere in memory (typically in bit-mapped form). Addressing logic then steps through the page memory on a character-by-character basis across each row. Within each row of characters, a line address counter determines which line of the character matrix is to be displayed. This is represented in FIG. 1 where, for example, the character "A" is shown as being part of a character cell matrix.

Each character is composed of a matrix of picture elements ("pixels") P with a set number of pixels in the horizontal direction X and a set number of lines in the vertical direction Y. As each character is addressed, the line counter addresses the line of pixels required. This line of pixels is then loaded into a serializer register at the frequency of the character clock signal, following which the pixel data is sequentially read out at the frequency of the pixel clock signal as a train of pulses.

If a sequential counter is used to generate the character line address information, each horizontal line of OSD pixels displayed on the screen will follow sequentially. In a typical monitor having multiple synchronization ("multi-sync") capabilities, the number of overall image lines displayed on the screen can vary depending upon the display format, or mode, being used.

Referring to FIG. 2, for example, VESA specifies several different modes of operation. As the monitor ensures that the height of the displayed image remains the same (typically 200 millimeters for a 17 inch CRT), the height of a single pixel row will decrease since the total number of vertical lines within the image increases. Therefore, if an OSD character has a fixed number of lines C (where typically C=18), then the character height will be reduced as the number of scan lines increases.

The OSD generator compensates for this variation in pixel height by increasing the number of lines within the character so as to maintain a constant character height. However, it is desirable that some control be allowed over the height of the OSD character by allowing variations in the number of character lines. Accordingly, since the number of lines that actually define the base character are fixed, the only way to increase the number of lines within the OSD character image is to repeat one or more of such defined lines. For example, to increase the displayed number of character lines from 18 to 20 lines, it becomes necessary to display two of the lines twice.

Therefore, in order to provide OSD characters of variable heights, it becomes necessary to use a character line address generation technique in which lines within the character can be repeated according to some predetermined algorithm. Additionally, such OSD addressing system must be capable of generating interlaced video in order to operate with interlaced image formats. (As is well known, in an interlaced image format, two successive fields are used to create one frame, with the even line numbers being displayed within the even field and the odd line numbers being displayed within the odd field. By displaying the odd lines and then the even lines in quick succession, the viewer is made to believe that the image is being refreshed at the field rate as opposed to half of the field rate.)

Referring to FIG. 3, in order to maintain a constant character height H, the number of lines N in an OSD character should, ideally, vary in direct proportion to the total number of lines V within the image. Three different example character heights are shown (Heights 1, 2 and 3). The minimum number of lines per character is indicated as being 18 since this corresponds to the number of lines in the basic character cell with no repeated lines.

Referring to FIG. 4, it can be seen how the displayed number of lines in an 18-line character cell must be increased for different numbers of image scan lines, where 320 image lines corresponds to the base 18 character lines (Height 2 within the graph of FIG. 3).

As a practical matter, almost any number of displayed image lines V may be displayed within an image provided that the OSD character line duplication system is capable of accounting for this when it is desired to maintain a constant character height. However, in actual practice, it has become acceptable within the display industry to allow some variation in OSD character height (e.g., +/−15% about the nominal base character height). This allows the line address duplication system to use the same duplication algorithm within bands of image line counts.

For example, FIG. 4 indicates that if 36 character lines are required within a 640 image line display, then 40 character lines are required for a 704 image line display. Therefore, 39 lines would theoretically be required for a 700 line image. However, in practice it may be acceptable to use the 36 character line repetition sequence for any number of image lines between 640 and 704 image lines. While this "rounding" approximation may create potential errors in the actual character heights compared to the ideal character heights, such errors are generally acceptable. (In this last example, the error would result in a variation of character height of less than +/−4% about the average period.)

It is possible to determine which lines of character image information should be repeated by using the ideal formula, shown below as Equation 1, to calculate the address for each character line, where TRUNC is a function which truncates to the integer value, H is the horizontal line number in the range of zero through N within the displayed character row, C is the number of lines within the base character matrix, and N is the required number of displayed character lines:

$$\text{Character Line Address} = TRUNC\left[\frac{H*C}{N}\right] \tag{1}$$

The resulting address information is shown in FIG. 5, where it can be seen, for example, that all the even numbered character lines are repeated for an image with a total number of image lines in the range of 486–587 lines. In this example, an arbitrary number of 18 character rows has been chosen for illustration, with each row having 18 lines within the character matrix. Thus, the lowest number of image lines that can be displayed without losing any OSD character lines is 18×18=324. This number can also be expressed by a variable Z, where Z is equal to the total number of OSD lines to be displayed within the vertical image space.

In this example, with Z=324, every line is displayed once in the 324 line mode. As the number of image lines is increased for a given value of Z, character lines are selectively repeated in order to maintain the same character height. At 648 image lines, i.e., 2*Z, each OSD character line must be displayed twice. As mentioned above, in order to simplify the system, the image line modes can be grouped into intervals. A suitable grouping is found by dividing the range between the 324 and the 648 line modes into four discrete equal intervals. For example, in this case, the interval is equal to 324/4=81. More generally, this interval can be expressed as a variable Y, where Y=Z/4. Thus, for example, image modes with a number of image lines in the range of 324–404 can use the same line repetition sequence with acceptable character height variation.

In a typical OSD character generator, the character line address generator is a binary counter which takes a synchronization pulse from the horizontal scan system for the display monitor. The counter then counts to the maximum line number (e.g., 18) and then resets itself to address the next row of characters. One way of repeating character lines is by selectively blanking the input pulses to the counter at the start of the line. Doing so produces a lower frequency pulse train, thereby causing the counter to count at a slower rate. For example, each character line can be repeated by simply blanking every alternate pulse.

Generally, to achieve the desired addressing, the average input frequency $F_A$ to the counter must be as represented by Equation 2 below (expressed as an average since the pulses must be synchronized to the horizontal line frequency), where $F_H$ is the horizontal line frequency, C is the number of lines within the base character matrix, and N is the required number of displayed character lines:

$$F_A = \frac{F_H * C}{N} \tag{2}$$

One conventional technique used to divide the incoming frequency by the appropriate factor is to use an analog or digital phase lock loop to generate the lower frequency. This method, however, has disadvantages of relatively high cost and high circuit complexity.

Another conventional technique is to use some form of arithmetic computation to calculate each character line address. Such technique repeatedly adds a binary number once every line period to a number contained within an accumulator register. When the sum overflows the register, the overflow bit is then used to clock the character address counter. While this technique may be appealing in some applications, it does have two distinct disadvantages. One disadvantage is the requirement of the additive integer to vary with the inverse of the number of displayed lines, thereby requiring either the external microprocessor or microcontroller to measure the line count and create the binary reciprocal, or requiring some complex logic within the OSD generator to create the binary reciprocal. Another disadvantage is the requirement of an arithmetic unit within the OSD generator to compute the address. Such arithmetic units are relatively large circuits and costly to implement.

Accordingly, it would be desirable to have a technique for generating a stream of pulses for a character line address counter at a close approximation to the desired frequency without requiring intervention by a microprocessor, microcontroller or complex arithmetic unit. Further, it would be desirable to use the image line count directly to allow the height of the displayed OSD characters to be set in accordance with a single parameter and remain constant thereafter. Further still, it would be desirable to achieve these goals with a design which is relatively low in complexity and, therefore, low in cost to implement.

SUMMARY OF THE INVENTION

In accordance with the present invention, an apparatus including a character line address counter clock signal generator and a method are provided for generating a character line address counter clock signal for an on screen display circuit used to selectively display a character image within an on screen display contained within a displayed screen image. The displayed character image has a scaled number of character image lines which is proportionately larger than a base number of character image lines for a base character image, the displayed screen image has a scaled number of screen image lines which is proportionately larger than a base number of screen image lines for a base screen image, and the proportionality of the scaled and base numbers of character image lines is substantially equal to the proportionality of the scaled and base numbers of screen image lines.

In accordance with one embodiment of the present invention, the character line address counter clock signal generator includes frequency divider circuits and a signal selection circuit. One frequency divider circuit is configured to receive and divide a horizontal synchronization signal by a first divisor and in accordance therewith provide a first quotient signal which corresponds to an integer R. Another frequency divider circuit, coupled to the first frequency divider circuit, is configured to receive the first quotient signal and in accordance therewith receive and divide an input clock signal by a second divisor which equals the integer R and in accordance therewith provide a second quotient signal, wherein the input clock signal and the horizontal synchronization signal have respective frequencies which are proportional by an integer factor of unity or more. The signal selection circuit, coupled to the frequency divider circuits, is configured to receive the first quotient signal and in accordance therewith receive and select one of the input clock and second quotient signals and in accordance therewith provide the character line address counter clock signal, wherein the scaled number of character image lines includes first and second alternating subsets of selected ones of the base character image lines which are used R times and R+1 times, respectively.

In accordance with another embodiment of the present invention, the character line address counter clock signal generator includes frequency divider circuits, a signal selection circuit and a divisor control circuit. One frequency divider circuit is configured to receive and divide a horizontal synchronization signal by a first divisor and in accordance therewith provide a first quotient signal which corresponds to an integer R and a second quotient signal which corresponds to an integer I. Another frequency divider circuit, coupled to the first frequency divider circuit, is configured to receive a divisor control signal and the first quotient signal and in accordance therewith receive and divide an input clock signal by a second divisor which alternately equals the integer R and another integer R+1 and in accordance therewith provide a third quotient signal, wherein the input clock signal and the horizontal synchronization signal have respective frequencies which are proportional by an integer factor of unity or more. The signal selection circuit, coupled to the frequency divider circuits, is configured to receive the first quotient signal and in accordance therewith receive and select one of the input clock and third quotient signals and in accordance therewith provide the character line address counter clock signal, wherein the scaled number of character image lines includes first and second alternating subsets of selected ones of the base character image lines which are used R times and R+1 times, respectively, in accordance with an interval corresponding to the integer I. The divisor control circuit, coupled to the frequency divider circuits, is configured to receive the second quotient signal and couple to and receive from a character line address counter circuit character line address signals which correspond to character line addresses for the base character image lines and in accordance therewith provide the divisor control signal.

In accordance with still another embodiment of the present invention, the method includes the steps of:

dividing a horizontal synchronization signal by a first divisor and in accordance therewith generating a first quotient signal which corresponds to an integer R;

receiving the first quotient signal and in accordance therewith receiving and dividing an input clock signal by a second divisor which equals the integer R and in accordance therewith generating a second quotient signal, wherein the input clock signal and the horizontal synchronization signal have respective frequencies which are proportional by an integer factor of unity or more; and receiving the first quotient signal and in accordance therewith receiving and selecting one of the input clock and second quotient signals and in accordance therewith generating the character line address counter clock signal, wherein the scaled number of character image lines includes first and second alternating subsets of selected ones of the base character image lines which are used R times and R+1 times, respectively.

In accordance with yet another embodiment of the present invention, the method includes the steps of:

dividing a horizontal synchronization signal by a first divisor and in accordance therewith generating a first quotient signal which corresponds to an integer R and a second quotient signal which corresponds to an integer I;

receiving a divisor control signal and the first quotient signal and in accordance therewith dividing an input clock signal by a second divisor which alternately equals the integer R and another integer R+1 and in accordance therewith generating a third quotient signal, wherein the input clock signal and the horizontal synchronization signal have respective frequencies which are proportional by an integer factor of unity or more;

receiving the first quotient signal and in accordance therewith selecting one of the input clock and third quotient signals and in accordance therewith generating the character line address counter clock signal, wherein the scaled number of character image lines includes first and second alternating subsets of selected ones of the base character image lines which are used R times and R+1 times, respectively, in accordance with an interval corresponding to the integer I; and receiving the second quotient signal and receiving from a character line address counter circuit character line address signals which correspond to character line addresses for the base character image lines and in accordance therewith generating the divisor control signal.

These and other features and advantages of the present invention will be understood upon consideration of the following detailed description of the invention and the accompanying drawings.

BRIEF DESCRIPTION OF THE DRAWINGS

FIG. 5 is a table containing the ideal line repetition sequences for maintaining constant OSD character heights.

FIG. 11 is a table containing the approximation repetition sequences in accordance with a second embodiment of the present invention.

FIG. 14 is a table illustrating the display of two sequential characters when operating in an interlaced display mode.

DETAILED DESCRIPTION OF THE INVENTION

A character line address counter clock signal generator in accordance with the present invention is based upon an observation of the characteristics of the line numbers contained in the table of FIG. 5. It can be seen that within any column each character address number is displayed a minimum number of R times and a maximum number of R+1 times. Furthermore, it can be seen that R is the integer number of times that the number of lines within the character matrix C (with C=18) will divide into the required number of image lines N to be displayed. Hence, on a truncated basis, R can be seen to be proportional to the overall image line count.

Figure 6:
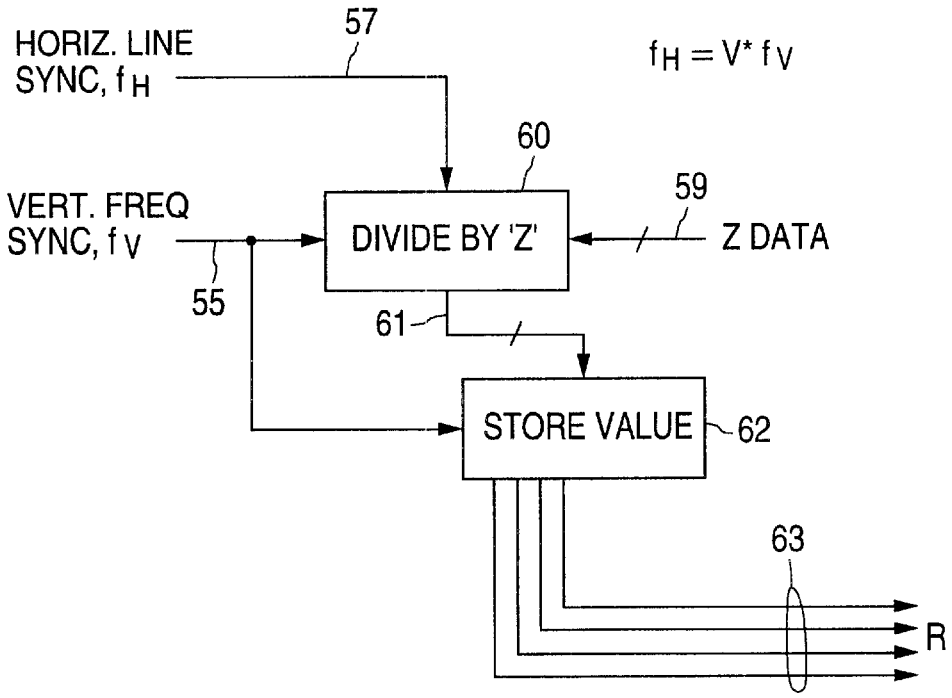
FIG. 6 is a functional block diagram of a first frequency divider circuit for use in a character line address counter clock signal generator in accordance with one embodiment of the present invention.

Referring to FIG. 6, a binary counter 60 is loaded with divisor data 59 representing a programmable integer value Z equal to the total number of OSD character lines to be displayed within the vertical image space. The horizontal synchronization signal 57, representing the total number of image lines V, is divided by this divisor Z to produce a count signal 61 which corresponds to a truncated integer count due to the resetting of the binary counter 60 by the vertical synchronization signal 55. This truncated count data 61 is latched in a storage circuit 62 (such as a latch or register circuit) in accordance with the vertical synchronization signal 55. The stored truncated count data 63 represents an integer R in accordance with Equation 3 below.

$$R = TRUNC\left[\frac{V}{Z}\right] \tag{3}$$

This integer R determines approximately how many times each character line must be repeated for maintaining a substantially constant character height. (For the simple case of a 4-bit register, this integer R would be a number in the range bounded by zero and 15.) By varying the value of the divisor parameter Z, the integer R, and thus the character height, can be scaled as desired.

Figure 7:
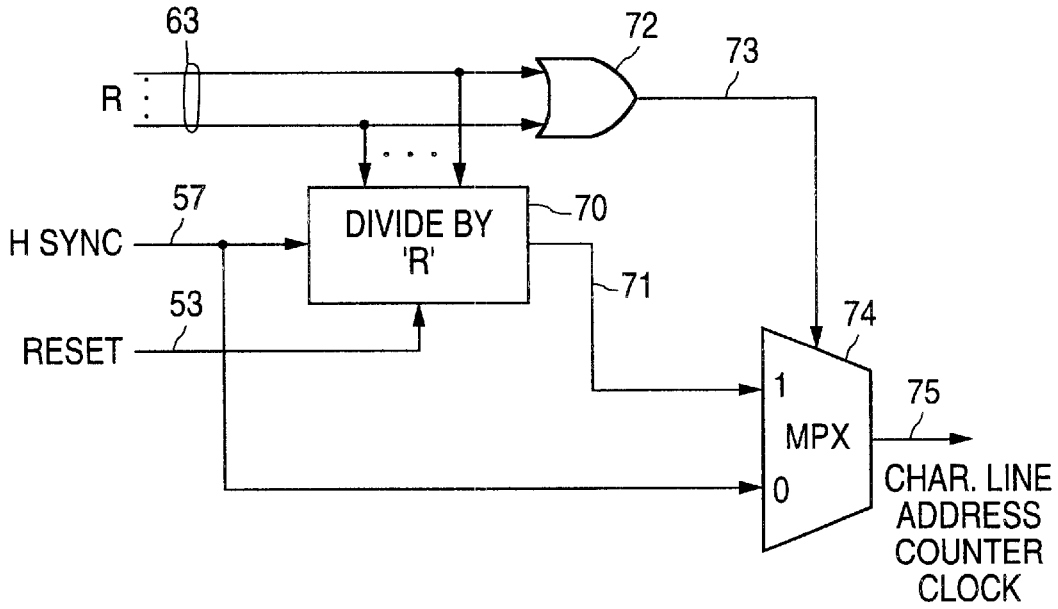
FIG. 7 is a functional block diagram of a second frequency divider circuit for use with the circuit of FIG. 6 to form a character line address counter clock signal generator in accordance with one embodiment of the present invention.

Referring to FIG. 7, the R data 63 is used to program another programmable counter 70to selectively frequency divide the horizontal synchronization signal 57. (A reset signal 53 resets the output count signal 71 when appropriate.) The R data 63 is also processed by a logic OR gate 72, the output 73 of which controls a 2:1 multiplexor 74 used to steer either the horizontal synchronization signal 57 or the count signal 71 to the output as the character line address counter clock signal 75.

When the R data 63 equals zero, the output 73 of the OR gate 72 is a logic zero, thereby causing the horizontal synchronization signal 57 to be used as the character line address counter clock signal 75. This indicates that the minimum number of lines per character are to be used (e.g., 18 character lines for the present example) and would, therefore, normally indicate that fewer lines should be displayed in order to maintain a constant character height. However, this would result in lost OSD character lines on the screen. Accordingly, an R data 63 value of zero disables any character line modification and the horizontal synchronization signal 57 is used directly. This means that below the base number of image lines, the base number of image lines are used regardless of the variation in character height that might otherwise result on the screen. (This is generally preferable to losing OSD character lines entirely.)

Whereas using R data as the indicator to increase the number of displayed character lines from the OSD character cell is simple, improved accuracy can be achieved by occasionally displaying selected OSD character lines R+1 times instead of R times at predetermined intervals. In the ideal case, such intervals will vary. For example, in the case of the 384-line mode of operation (FIG. 5) R is unity, thereby causing each character line to nominally be displayed once. Therefore, lines 1, 2 and 3 are displayed R times, i.e., once; however, lines 0 and 4 are displayed R+1 times, i.e., twice. While this would seem to indicate that the interval between R+1 display occurrences might be every fourth line, this is not true for lines 5, 6, 7, 8 and 9 where the ninth line is displayed twice, i.e., at an interval of five.

Figures 1, 2:
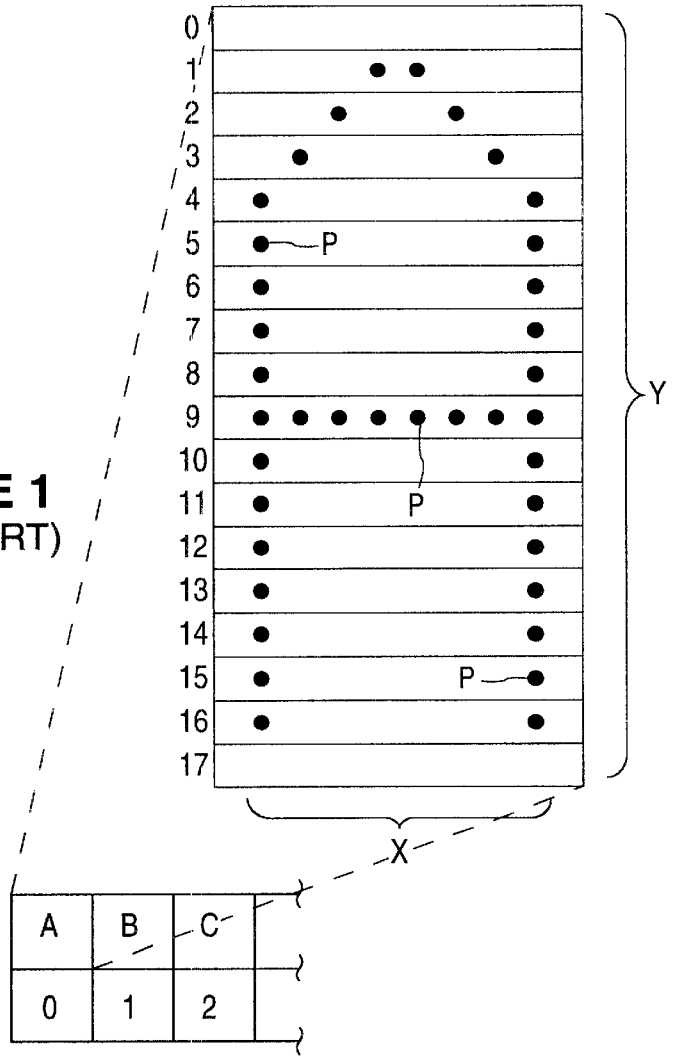
FIGURE 1 (PRIOR ART)
FIGURE 2 (PRIOR ART)
FIG. 1 illustrates the concept of bit-mapped base character pixel information within a base character cell matrix.
FIG. 2 is a table of operation modes for multi-sync monitors with OSD character generators.
Figures 3, 4, 8:
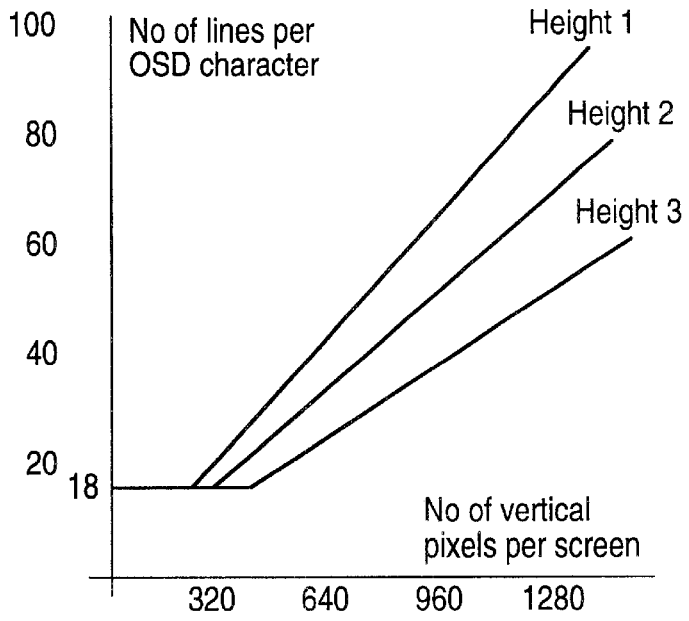
FIGURE 3 (PRIOR ART)
FIGURE 4 (PRIOR ART)
FIG. 3 is a graph illustrating variations of numbers of displayed OSD character lines in accordance with the number of vertical pixels within the displayed screen image.
FIG. 4 is a table of the number of OSD character lines required in different image modes of operation.
FIG. 8 is a table of a line repetition sequence in accordance with another embodiment of the present invention.

Referring to FIG. 8, if a predetermined repetition sequence between the occurrences of line displays of R+1 times is used, a reasonable approximation to the required character line address sequence can be achieved. In this example, four different sequences are used as indicated by the value of a 2-bit interval integer I. As shown, where L is the line number of the OSD character being displayed, the pattern repeats every four lines of the OSD character. The interval integer I can be easily determined by changing the divisor Z (FIG. 6) to a lower value Y where Y=Z/4 (for four different repetition sequences as determined in accordance with I).

Figures 9, 10, 12:
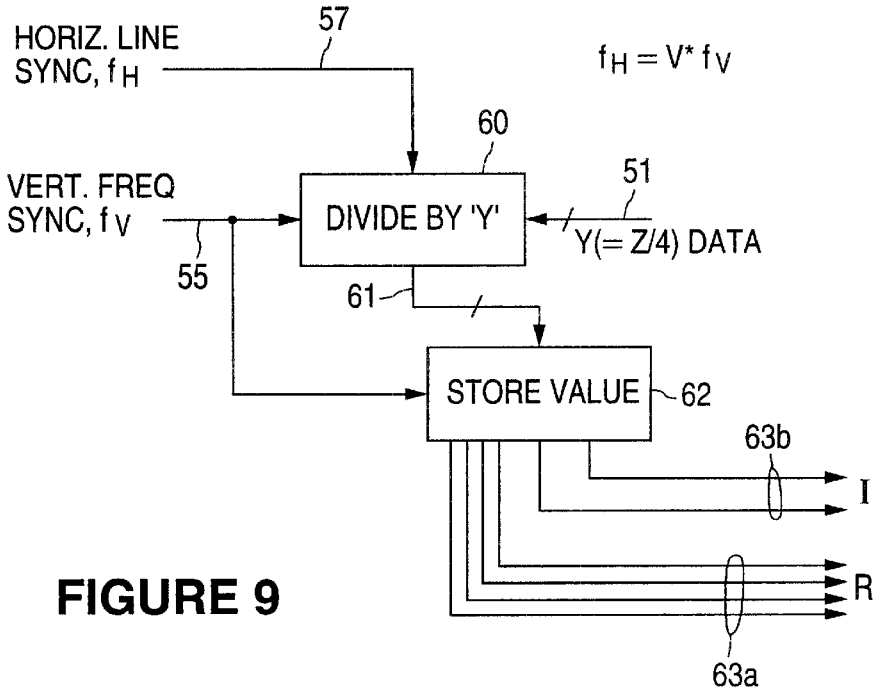
FIG. 9 is a functional block diagram of an alternative first frequency divider circuit for use in a character line address counter clock signal generator in accordance with another embodiment of the present invention.
FIG. 10 is a table illustrating derivations of the repetition sequence factors from the image line count as performed by the circuit of FIG. 9.
FIG. 12 is a table comparing the ideal repetition sequences to the approximation method in accordance with the present invention.

Referring to FIG. 9, this reduced divisor Y gives a higher valued output 61 from the divider (by a factor of four). The two least significant bits 63*b* can be used for the integer I, while the remaining more significant bits 63*a* are used to represent the integer R. By way of example, if 324 OSD character lines are required on the screen, then Z=324 and Y=81. Depending upon the number of lines in the image, the values of R and I will be as shown in FIG. 10.

Referring to FIG. 11, using a fixed repetition interval I and a value of Y=81 a comparison of the results with the ideal results shown in FIG. 5 demonstrates that this technique for generating repetition sequences produces results that are close to the theoretical ideal results. Referring to FIG. 12, the actual number of lines in a character using this approximation is compared to the ideal number and it can be seen that this approximation technique provides a good approximation to the ideal result.

As noted, the divisor Y can be chosen to scale the character height. In this example, the divisor Y has been chosen to give exactly 18 OSD character lines when operating in a 324-line image mode. However, divisor Y can be programmed to scale the heights of the OSD characters in any mode as desired. For example, changing the divisor Y to 56 will produce 24 OSD character lines in a 320-line image mode (i.e., a taller character) and result in values of R=1 and I=2 for such mode. Accordingly, an important property of this technique is that the divisor Y can be defined by the user to set the OSD character height regardless of the mode of operation.

Figure 13:
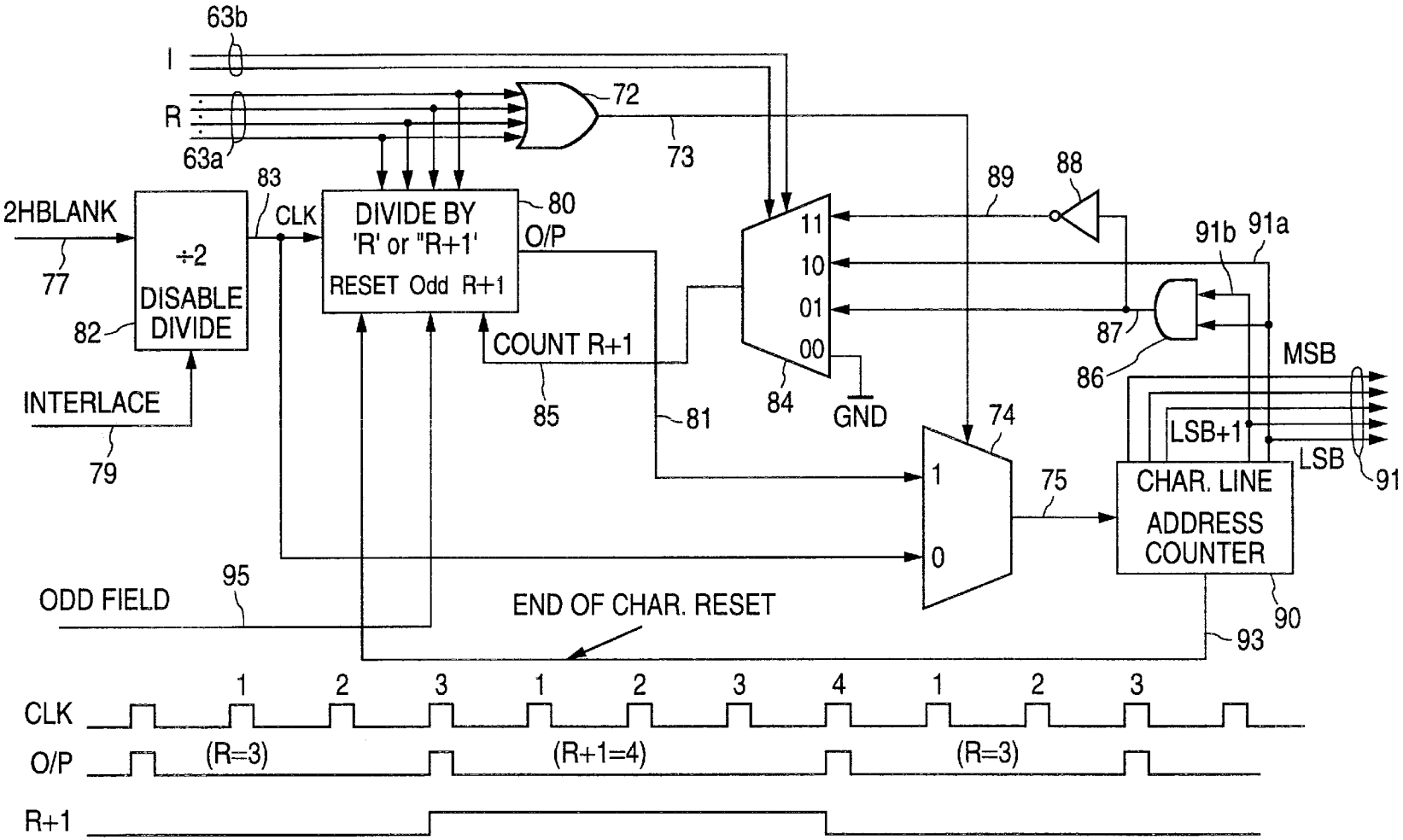
FIG. 13 is a functional block diagram of a character line address counter clock signal generator in accordance with another embodiment of the present invention.

Referring to FIG. 13, a practical implementation of such a character line repetition circuit includes, in addition to the OR gate 72 and 2:1 multiplexor 74 (FIG. 7), a dual modulus counter 80, a programmable divide-by-two circuit 82, a 4:1 multiplexor 84 and some logic circuitry 86, 88 for driving the character line address counter 90. (It should be understood that the combinational logic circuitry in the form of an AND gate 86 and inverter 88 could be replaced with a lookup table as an alternative.) The input signal 77 to this circuit is a pulse stream from a pixel clock generator running at twice the frequency of the horizontal synchronization signal 57 (e.g., generated by a phase lock loop). For progressive scan modes of operation, the interlace control signal 79 is de-asserted and the divide-by-two stage 82 divides the frequency of the input pulse stream 77 down to the normal horizontal rate. If, however, the interlace control signal 79 is asserted, then the divide-by-two stage 82 is effectively disabled and the clock signal 83 has a frequency at two times the horizontal rate.

The dual modulus counter 80 divides its input clock signal 83 by an integer equal to either R or R+1, depending upon the status of the "count R+1" control signal 85, thereby producing a pulsed count signal 81 with a repetition rate equal to the frequency of the horizontal synchronization signal divided by either R ($F_H$/R) or R+1 ($F_H$/(R+1)). This pulsed signal 81 is provided as the clock signal 75 to the character line address counter 90 via the multiplexor 74, provided that R is greater than zero. If R is equal to zero, as discussed above, then the multiplexor 74 steers the input clock signal 83 directly to the character line address counter 90 as the clock signal 75, thereby bypassing the counter 80.

The character line address counter 90 counts from zero through 17 (for this example of 18 base character lines) for addressing the lines in the base character cell. When the maximum address line of 17 has been reached, the address counter 90 resets itself and asserts a reset signal 93 to reset the counter 80 to zero. The two least significant bits 91*a*, 91*b* of the character line address counter output 91 are fed back via the combinational logic 86, 88 to the 4:1 multiplexor 84. This multiplexor 84, depending upon the value of the integer I, steers one of its input signals to the counter 80 as the "count R+1" control signal 85 in accordance with the sequences shown in FIG. 8.

In accordance with the foregoing, it should be understood that if the interlaced control signal 79 is asserted then the line address information 91 would count at double the horizontal rate, thereby missing every other line. In order to alternate between odd and even field character addresses, an odd field control signal 95 is provided which, when asserted, increments the first divide-by-R count of the dual modulus counter 80, thereby starting the count on the odd horizontal synchronization pulse sequence. (It should be understood that in the circuit implementation of FIG. 7 a programmable divide-by-two circuit 82 can be included to divide the horizontal synchronization signal 57 and the programmable counter 70 can be driven with an odd field control signal 95 when using such a circuit to display interlaced images.) This control signal 95 is generated such that it only occurs at the start of the field, thereby offsetting the entire field count by one to ensure that the odd field character lines are addressed in accordance with the chart in FIG. 14.

Based upon the foregoing discussion, it can be seen that a character line address counter clock signal generator in accordance with the present invention provides an accurate approximation for character line address repetition sequences as required to maintain constant OSD character height. The disclosed technique is simple, yet effective, and requires no intervention by a microprocessor or microcontroller other than perhaps to set an optional parameter for scaling the character height as desired. Furthermore, such a generator can operate correctly with both interlaced and noninterlaced (i.e., progressive) display formats.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R;

a second frequency divider circuit, coupled to said first frequency divider circuit, that receives said first quotient signal and in response thereto receives and divides an input clock signal by a second divisor which equals said integer R and provides a second quotient signal, wherein said input clock signal and said horizontal synchronization signal have respective frequencies which are proportional by an integer factor of unity or more; and a signal selection circuit, coupled to said first and second frequency divider circuits, that receives said first quotient signal and in response thereto receives and selects one of said input clock and second quotient signals and provides said character line address counter clock signal, wherein said scaled number of character image lines includes first and second alternating subsets of selected ones of said base character image lines which are used R times and R+1 times, respectively.

2. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R, wherein said first frequency divider circuit includes a programmable counter circuit that receives a reset signal and a control signal which represents said first divisor and in response thereto receives and divides said horizontal synchronization signal by said first divisor and provides a plurality of data signals which represents said integer R, and a data storage circuit, coupled to said programmable counter circuit, that receives a storage control signal and in response thereto receives and stores said plurality of data signals and provides a plurality of stored data signals as said first quotient signal;

a second frequency divider circuit, coupled to said first frequency divider circuit, that receives said first quotient signal and in response thereto receives and divides an input clock signal by a second divisor which equals said integer R and provides a second quotient signal, wherein said input clock signal and said horizontal synchronization signal have respective frequencies which are proportional by an integer factor of unity or more; and a signal selection circuit, coupled to said first and second frequency divider circuits, that receives said first quotient signal and in response thereto receives and selects one of said input clock and second quotient signals and provides said character line address counter clock signal, wherein said scaled number of character image lines includes first and second alternating subsets of selected ones of said base character image lines which are used R times and R+1 times, respectively.

3. The apparatus of claim 2, wherein said integer R equals an integer truncation of a quotient of said scaled number of screen image lines and said first divisor.

4. The apparatus of claim 2, wherein:

said programmable counter circuit receives a vertical synchronization signal as said reset signal; and said data storage circuit receives said vertical synchronization signal as said storage control signal.

5. The apparatus of claim 1, wherein said second frequency divider circuit comprises a programmable counter circuit that receives a reset signal and said horizontal synchronization signal as said input clock signal.

6. The apparatus of claim 1, wherein said second frequency divider circuit comprises:

a third frequency divider circuit that receives a control signal and in response thereto receives and selectively divides said input clock signal and provides a selectively divided clock signal; and a programmable counter circuit, coupled to said third frequency divider circuit, that receives a reset signal and said selectively divided clock signal and provides said second quotient signal.

7. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R;

a second frequency divider circuit, coupled to said first frequency divider circuit, that receives said first quotient signal and in response thereto receives and divides an input clock signal by a second divisor which equals said integer R and provides a second quotient signal, wherein said input clock signal and said horizontal synchronization signal have respective frequencies which are proportional by an integer factor of unity or more, wherein said second frequency divider circuit comprises a third frequency divider circuit that receives a control signal and in response thereto receives and selectively divides said input clock signal and provides a selectively divided clock signal, and a programmable counter circuit, coupled to said third frequency divider circuit, that receives a reset signal and said selectively divided clock signal and provides said second quotient signal; and a signal selection circuit, coupled to said first and second frequency divider circuits, that receives said first quotient signal and in response thereto receives and selects one of said input clock and second quotient signals and provides said character line address counter clock signal, wherein said scaled number of character image lines includes first and second alternating subsets of selected ones of said base character image lines which are used R times and R+1 times, respectively;

wherein said character line address counter clock signal generator is for generating a character line address counter clock signal for an on screen display circuit used to selectively display character images within on screen displays contained within noninterlaced and interlaced displayed screen images, said control signal includes first and second signal states which correspond to noninterlaced and interlaced displayed screen images, respectively, said programmable counter circuit further receives a count increment signal and in response thereto initially increments said second quotient signal for said interlaced displayed screen images, said selectively divided clock signal has a lower frequency than said input clock signal during said first control signal state, and said selectively divided clock signal and said input clock signal have equal frequencies during said second control signal state.

8. The apparatus of claim 7, further comprising an address counter circuit, coupled to said signal selection circuit, that receives said character line address counter clock signal and in response thereto provides a plurality of character line address signals which correspond to a plurality of character line addresses for said base character image lines.

9. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R;

a second frequency divider circuit, coupled to said first frequency divider circuit, that receives said first quotient signal and in response thereto receives and divides an input clock signal by a second divisor which equals said integer R and provides a second quotient signal, wherein said input clock signal and said horizontal synchronization signal have respective frequencies which are proportional by an integer factor of unity or more; and a signal selection circuit, coupled to said first and second frequency divider circuits, that receives said first quotient signal and in response thereto receives and selects one of said input clock and second quotient signals and provides said character line address counter clock signal, wherein said scaled number of character image lines includes first and second alternating subsets of selected ones of said base character image lines which are used R times and R+1 times, respectively, wherein said signal selection circuit includes a logic circuit that receives said first quotient signal and in response thereto provides a signal selection control signal, and a signal steering circuit, coupled to said logic circuit, that receives said signal selection control signal and in response thereto receives and steers said one of said input clock and second quotient signals and provides said character line address counter clock signal.

10. The apparatus of claim 9, wherein:

said logic circuit comprises an OR gate; and said signal steering circuit comprises a multiplexor circuit.

11. The apparatus of claim 1, further comprising an address counter circuit, coupled to said signal selection circuit, that receives said character line address counter clock signal and in response thereto provides a plurality of character line address signals which correspond to a plurality of character line addresses for said base character image lines.

12. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R and a second quotient signal which corresponds to an integer I;

a second frequency divider circuit, coupled to said first frequency divider circuit, that receives a divisor control signal and said first quotient signal and in response thereto receives and divides an input clock signal by a second divisor which alternately equals said integer R and another integer R+1 and provides a third quotient signal, wherein said input clock signal and said horizontal synchronization signal have respective frequencies which are proportional by an integer factor of unity or more;

a signal selection circuit, coupled to said first and second frequency divider circuits, that receives said first quotient signal and in response thereto receives and selects one of said input clock and third quotient signals and provides said character line address counter clock signal, wherein said scaled number of character image lines includes first and second alternating subsets of selected ones of said base character image lines which are used R times and R+1 times, respectively, in correspondence with an interval corresponding to said integer I; and a divisor control circuit, coupled to said first and second frequency divider circuits, that receives said second quotient signal and is adapted to couple to and receive from a character line address counter circuit a plurality of character line address signals which correspond to a plurality of character line addresses for said base character image lines and provide said divisor control signal.

13. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R and a second quotient signal which corresponds to an integer I, wherein said first frequency divider circuit includes a programmable counter circuit that receives a reset signal and a control signal which represents said first divisor and in response thereto receives and divides said horizontal synchronization signal by said first divisor and provides a plurality of data signals which represents said integers R and I, and a data storage circuit, coupled to said programmable counter circuit, that receives a storage control signal and in response thereto receives and stores said plurality of data signals and provides a plurality of stored data signals as said first quotient signal a second frequency divider circuit, coupled to said first frequency divider circuit, that receives a divisor control signal and said first quotient signal and in response thereto receives and divides an input clock signal by a second divisor which alternately equals said integer R and another integer R+1 and provides a third quotient signal, wherein said input clock signal and said horizontal synchronization signal have respective frequencies which are proportional by an integer factor of unity or more;

a signal selection circuit, coupled to said first and second frequency divider circuits, that receives said first quotient signal and in response thereto receives and selects one of said input clock and third quotient signals and provides said character line address counter clock signal, wherein said scaled number of character image lines includes first and second alternating subsets of selected ones of said base character image lines which are used R times and R+1 times, respectively, in correspondence with an interval corresponding to said integer I; and a divisor control circuit, coupled to said first and second frequency divider circuits, that receives said second quotient signal and is adapted to couple to and receive from a character line address counter circuit a plurality of character line address signals which correspond to a plurality of character line addresses for said base character image lines and provide said divisor control signal.

14. The apparatus of claim 13, wherein:

said plurality of data signals represents an integer truncation of a quotient of said scaled number of screen image lines and said first divisor;

one portion of said plurality of data signals corresponds to said integer R; and another portion of said plurality of data signals corresponds to said integer I.

15. The apparatus of claim 13, wherein:

said programmable counter circuit receives a vertical synchronization signal as said reset signal; and said data storage circuit receives said vertical synchronization signal as said storage control signal.

16. The apparatus of claim 12, wherein said second frequency divider circuit comprises a programmable counter circuit that receives a reset signal, a count modulus control signal as said divisor control signal, and said horizontal synchronization signal as said input clock signal.

17. The apparatus of claim 12, wherein said second frequency divider circuit comprises:

a third frequency divider circuit that receives a control signal and in response thereto receives and selectively divides said input clock signal and provides a selectively divided clock signal; and a programmable counter circuit, coupled to said third frequency divider circuit, that receives a reset signal, a count modulus control signal as said divisor control signal, and said selectively divided clock signal and in response thereto provides said third quotient signal.

18. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R and a second quotient signal which corresponds to an integer I;

a second frequency divider circuit, coupled to said first frequency divider circuit, that receives a divisor control signal and said first quotient signal and in response thereto receives and divides an input clock signal by a second divisor which alternately equals said integer R and another integer R+1 and provides a third quotient signal, wherein said input clock signal and said horizontal synchronization signal have respective frequencies which are proportional by an integer factor of unity or more, wherein said second frequency divider circuit includes a third frequency divider circuit that receives a control signal and in response thereto receives and selectively divides said input clock signal and provides a selectively divided clock signal, and a programmable counter circuit, coupled to said third frequency divider circuit, that receives a reset signal, a count modulus control signal as said divisor control signal, and said selectively divided clock signal and in response thereto provides said third quotient signal;

a signal selection circuit, coupled to said first and second frequency divider circuits, that receives said first quotient signal and in response thereto receives and selects one of said input clock and third quotient signals and provides said character line address counter clock signal, wherein said scaled number of character image lines includes first and second alternating subsets of selected ones of said base character image lines which are used R times and R+1 times, respectively, in correspondence with an interval corresponding to said integer I; and a divisor control circuit, coupled to said first and second frequency divider circuits, that receives said second quotient signal and is adapted to couple to and receive from a character line address counter circuit a plurality of character line address signals which correspond to a plurality of character line addresses for said base character image lines and provide said divisor control signal;

wherein said character line address counter clock signal generator is for generating a character line address counter clock signal for an on screen display circuit used to selectively display character images within on screen displays contained within noninterlaced and interlaced displayed screen images, said control signal includes first and second signal states which correspond to noninterlaced and interlaced displayed screen images, respectively, said programmable counter circuit is further configured to receive a count increment signal and in accordance therewith initially increment said third quotient signal for said interlaced displayed screen images, said selectively divided clock signal has a lower frequency than said input clock signal during said first control signal state, and said selectively divided clock signal and said input clock signal have equal frequencies during said second control signal state.

19. The apparatus of claim 18, further comprising an address counter circuit, coupled to said signal selection circuit and said divisor control circuit, that receives said character line address counter clock signal and in response thereto provides said plurality of character line address signals.

20. An apparatus including a character line address counter clock signal generator for generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said character line address counter clock signal generator comprises:

a first frequency divider circuit that receives and divides a horizontal synchronization signal by a first divisor and provides a first quotient signal which corresponds to an integer R and a second quotient signal which corresponds to an integer I;

a second frequency divider circuit, coupled to said first frequency divide circuit, that receives a divisor control signal and said first quotient signal and in response thereto receives and divides an input clock signal by a second divisor which alternately equals said integer R and another integer R+1 and provides a third quotient signal, wherein said input clock signal and said horizontal synchronization signal have respective frequencies which are proportional by an integer factor of unity or more;

a signal selection circuit, coupled to said first and second frequency divider circuits, that receives said first quotient signal and in response thereto receives and selects one of said input clock and third quotient signals and provides said character line address counter clock signal, wherein said scaled number of character image lines includes first and second alternating subsets of selected ones of said base character image lines which are used R times and R+1 times, respectively, in correspondence with an interval corresponding to said integer I, wherein said signal selection circuit includes a logic circuit that receives said first quotient signal and in response thereto provides a signal selection control signal; and a signal steering circuit, coupled to said logic circuit, that receives said signal selection control signal and in response thereto receives and steers said one of said input clock and third quotient signals and provides said character line address counter clock signal; and a divisor control circuit, coupled to said first and second frequency divider circuits, that receives said second quotient signal and is adapted to couple to and receive from a character line address counter circuit a plurality of character line address signals which correspond to a plurality of character line addresses for said base character image lines and provide said divisor control signal.

21. The apparatus of claim 20, wherein:

said logic circuit comprises an OR gate; and said signal steering circuit comprises a multiplexor circuit.

22. The apparatus of claim 12, further comprising an address counter circuit, coupled to said signal selection circuit and said divisor control circuit, that receives said character line address counter clock signal and in response thereto provides said plurality of character line address signals.

23. A method of generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said method comprises the steps of:

dividing a horizontal synchronization signal by a first divisor and generating a first quotient signal which corresponds to an integer R;

receiving said first quotient signal and in response thereto receiving and dividing an input clock signal by a second divisor which equals said integer R and generating a second quotient signal, wherein said input clock signal and said horizontal synchronization signal have respective frequencies which are proportional by an integer factor of unity or more; and receiving said first quotient signal and in response thereto receiving and selecting one of said input clock and second quotient signals and generating said character line address counter clock signal, wherein said scaled number of character image lines includes first and second alternating subsets of selected ones of said base character image lines which are used R times and R+1 times, respectively.

24. The method of claim 23, wherein said step of receiving said first quotient signal and in response thereto receiving and dividing an input clock signal by a second divisor which equals said integer R and generating a second quotient signal comprises:

selectively dividing said input clock signal and generating a selectively divided clock signal; and generating said second quotient signal in response to said selectively divided clock signal.

25. A method of generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said method comprises the steps of:

dividing a horizontal synchronization signal by a first divisor and generating a first quotient signal which corresponds to an integer R;

receiving said first quotient signal and in response thereto receiving and dividing an input clock signal by a second divisor which equals said integer R and generating a second quotient signal by selectively dividing said input clock signal and generating a selectively divided clock signal, and generating said second quotient signal in response to said selectively divided clock signal, wherein said input clock signal and said horizontal synchronization signal have respective frequencies which are proportional by an integer factor of unity or more; and receiving said first quotient signal and in response thereto receiving and selecting one of said input clock and second quotient signals and generating said character line address counter clock signal, wherein said scaled number of character images lines includes first and second alternating subsets of selected ones of said base character image lines which are used R times and R+1 times, respectively;

wherein said character line address counter clock signal generator is for generating a character line address counter clock signal for an on screen display circuit used to selectively display character images within on screen displays contained within noninterlaced and interlaced displayed screen images, said step of generating said second quotient signal in response to said selectively divided clock signal comprises initially incrementing said second quotient signal for said interlaced displayed screen images, and said step of selectively dividing said input clock signal and generating a selectively divided clock signal comprises generating said selectively divided clock signal at a lower frequency than said input clock signal for noninterlaced displayed screen images, and generating said selectively divided clock signal at a frequency equal to said input clock signal for interlaced displayed screen images.

26. The method of claim 25, further comprising the step of:

generating, in response to said character line address counter clock signal, a plurality of character line address signals which correspond to a plurality of character line addresses for said base character image lines.

27. The method of claim 23, further comprising the step of generating, in response to said character line address counter clock signal, a plurality of character line address signals which correspond to a plurality of character line addresses for said base character image lines.

28. A method of generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said method comprises the steps of:

dividing a horizontal synchronization signal by a first divisor and generating a first quotient signal which corresponds to an integer R and a second quotient signal which corresponds to an integer I;

receiving a divisor control signal and said first quotient signal and in response thereto dividing an input clock signal by a second divisor which alternately equals said integer R and another integer R+1 and generating a third quotient signal, wherein said input clock signal and said horizontal synchronization signal have respective frequencies which are proportional by an integer factor of unity or more;

receiving said first quotient signal and in response thereto selecting one of said input clock and third quotient signals and generating said character line address counter clock signal, wherein said scaled number of character image lines includes first and second alternating subsets of selected ones of said base character image lines which are used R times and R+1 times, respectively, in correspondence with an interval corresponding to said integer I; and receiving said second quotient signal and receiving from a character line address counter circuit a plurality of character line address signals which correspond to a plurality of character line addresses for said base character image lines and generating said divisor control signal.

29. The method of claim 28, wherein said step of receiving a divisor control signal and said first quotient signal and in response thereto dividing an input clock signal by a second divisor which alternately equals said integer R and another integer R+1 and generating a third quotient signal comprises:

selectively dividing said input clock signal and generating a selectively divided clock signal;

receiving a count modulus control signal as said divisor control signal; and generating said third quotient signal in response to said count modulus control signal and said selectively divided clock signal.

30. A method of generating a character line address counter clock signal for an on screen display circuit used to selectively display a character image within an on screen display contained within a displayed screen image, wherein:

said displayed character image has a scaled number of character image lines which is proportionately larger than a base number of character image lines for a base character image;

said displayed screen image has a scaled number of screen image lines which is proportionately larger than a base number of screen image lines for a base screen image;

said proportionality of said scaled and base numbers of character image lines is substantially equal to said proportionality of said scaled and base numbers of screen image lines; and said method comprises the steps of:

dividing a horizontal synchronization signal by a first divisor and generating a first quotient signal which corresponds to an integer R and a second quotient signal which corresponds to an integer I;

receiving a divisor control signal and said first quotient signal and in response thereto dividing an input clock signal by a second divisor which alternately equals said integer R and another integer R+1 and generating a third quotient signal by selectively dividing said input clock signal and generating a selectively divided clock signal, receiving a count modulus control signal as said divisor control signal, and generating said third quotient signal in response to said count modulus control signal and said selectively divided clock signal, wherein said input clock signal and said horizontal synchronization signal have respective frequencies which are proportional by an integer factor of unity or more;

receiving said first quotient signal and in response thereto selecting one of said input clock and third quotient signals and generating said character line address counter-clock signal, wherein said scaled number of character image lines includes first and second alternating subsets of selected ones of said base character image lines which are used R times and R+1 times, respectively, in correspondence with an interval corresponding to said integer I; and receiving said second quotient signal and receiving from a character line address counter circuit a plurality of character line address signals which correspond to a plurality of character line addresses for said base character image lines and generating said divisor control signal;

wherein said character line address counter clock signal generator is for generating a character line address counter clock signal for an on screen display circuit used to selectively display character images within on screen displays contained within noninterlaced and interlaced displayed screen images, said step of generating said third quotient signal in response to said count modulus control signal and said selectively divided clock signal comprises initially incrementing said third quotient signal for said interlaced displayed screen images, and said step of selectively dividing said input clock signal and generating a selectively divided clock signal comprises generating said selectively divided clock signal at a lower frequency than said input clock signal for noninterlaced displayed screen images, and generating said selectively divided clock signal at a frequency equal to said input clock signal for interlaced displayed screen images.

31. The method of claim 30, further comprising the step of:

generating, in response to said character line address counter clock signal, a plurality of character line address signals which correspond to a plurality of character line addresses for said base character image lines.

32. The method of claim 28, further comprising the step of generating, in response to said character line address counter clock signal, a plurality of character line address signals which correspond to a plurality of character line addresses for said base character image lines.

* * * * *